US008082937B2

(12) United States Patent
Tarter et al.

(10) Patent No.: US 8,082,937 B2
(45) Date of Patent: Dec. 27, 2011

(54) TENT ELECTRICAL SYSTEM

(76) Inventors: Kevin J. Tarter, Wichita, KS (US); Stuart L. Meether, Wichita, KS (US); Trevor J. Hinz, Wichita, KS (US); Yiyun Culp, Wichita, KS (US); Michael D. Brockel, Wichita, KS (US); Robert L. Lawhon, Andover, KS (US)

( * ) Notice: Subject to any disclaimer, the term of this patent is extended or adjusted under 35 U.S.C. 154(b) by 0 days.

(21) Appl. No.: 12/903,047

(22) Filed: Oct. 12, 2010

(65) Prior Publication Data

US 2011/0023923 A1 Feb. 3, 2011

Related U.S. Application Data

(62) Division of application No. 12/057,184, filed on Mar. 27, 2008, now Pat. No. 7,836,905.

(60) Provisional application No. 60/721,281, filed on Sep. 28, 2005, provisional application No. 60/774,371, filed on Feb. 17, 2006.

(51) Int. Cl.
*E04H 15/10* (2006.01)

(52) U.S. Cl. ..... 135/91; 135/96

(58) Field of Classification Search ..... 135/120.1, 135/120.3, 120.4, 91, 910, 96
See application file for complete search history.

(56) References Cited

U.S. PATENT DOCUMENTS

| | | | | |
|---|---|---|---|---|
| 1,409,609 | A | | 3/1922 | Stockle |
| 1,563,736 | A | | 12/1925 | Fink |
| 2,756,760 | A | | 7/1956 | Grotteria |
| 3,042,052 | A | | 7/1962 | Des Rosier |
| 3,092,854 | A | * | 6/1963 | Manhart ..... 441/38 |
| 3,380,087 | A | | 4/1968 | Petty et al. |
| 3,502,091 | A | | 3/1970 | Corbin |
| 3,699,986 | A | | 10/1972 | Kirkham |
| 3,724,473 | A | | 4/1973 | Moss |
| 3,767,911 | A | | 10/1973 | Oakley et al. |
| 3,965,915 | A | | 6/1976 | Kirkham |
| 4,004,132 | A | | 1/1977 | Glass et al. |
| 4,063,566 | A | | 12/1977 | Millerioux |
| 4,074,682 | A | | 2/1978 | Yoon |
| 4,078,572 | A | | 3/1978 | Moss |
| 4,102,352 | A | | 7/1978 | Kirklham |

(Continued)

FOREIGN PATENT DOCUMENTS

DE 4023550 1/1992

(Continued)

OTHER PUBLICATIONS

Coleman 2000 Outdoor Product Catalog, The Coleman Company, Inc., Wichita, Kansas, pp. 89-90, 1999.

(Continued)

*Primary Examiner* — Noah Chandler Hawk

(57) ABSTRACT

An electrical system (60, 200) for a tent or shelter (98, 201). Wires (60) are routed through a tent or shelter (98, 201) either by attaching the wires to the tent or shelter, running the wires through hems, seams (100), or sleeves, or integrating the wires into the fabric for the tent or shelter. In accordance with an embodiment, an appliance (208) is connected to the wiring harness (60) and is mounted or attached in the tent or shelter. The appliance (208) may be mounted in a socket (234) that includes contacts that may engage a fixture or appliance, such as a light. An opposite end of a cord (222) leading to the socket is attachable to an electrical power supply, such as a battery pack (203).

3 Claims, 4 Drawing Sheets

U.S. PATENT DOCUMENTS

| | | | | |
|---|---|---|---|---|
| 4,294,486 | A | 10/1981 | Espejo | |
| 4,354,091 | A | 10/1982 | Bain | |
| 4,408,260 | A | 10/1983 | Miedel et al. | |
| 4,448,388 | A | 5/1984 | Dennis et al. | |
| 4,582,062 | A | 4/1986 | Albini | |
| 4,865,066 | A | 9/1989 | Brooks | |
| 4,866,833 | A | 9/1989 | Ward | |
| 4,996,970 | A | 3/1991 | Legare | |
| 5,178,453 | A * | 1/1993 | Runels | 362/398 |
| 5,192,126 | A | 3/1993 | Remeyer et al. | |
| 5,216,948 | A * | 6/1993 | Sheppard et al. | 99/483 |
| 5,222,513 | A | 6/1993 | Hilliard | |
| 5,394,897 | A | 3/1995 | Ritchey et al. | |
| 5,398,463 | A | 3/1995 | Wright | |
| 5,465,196 | A | 11/1995 | Hasenberg et al. | |
| 5,487,240 | A | 1/1996 | Miller | |
| 5,544,671 | A | 8/1996 | Phillips | |
| 5,848,837 | A | 12/1998 | Gustafson | |
| 5,857,477 | A | 1/1999 | James | |
| 5,862,826 | A | 1/1999 | Gremont | |
| 5,908,043 | A | 6/1999 | Paes et al. | |
| 5,916,096 | A | 6/1999 | Wiesmann et al. | |
| 5,918,615 | A | 7/1999 | Stuck, Sr. | |
| 5,930,854 | A | 8/1999 | O'Neill et al. | |
| 5,954,076 | A | 9/1999 | McGinnis | |
| 5,970,661 | A | 10/1999 | Bishop et al. | |
| 6,035,876 | A | 3/2000 | Stover et al. | |
| 6,056,623 | A | 5/2000 | Arriola | |
| 6,179,358 | B1 | 1/2001 | Hirayama et al. | |
| 6,266,927 | B1 | 7/2001 | Leslie | |
| 6,273,114 | B1 | 8/2001 | Schaefer | |
| 6,302,094 | B1 | 10/2001 | Wehrly et al. | |
| 6,302,560 | B1 | 10/2001 | Lai | |
| 6,338,356 | B1 * | 1/2002 | Wallenstatter | 135/100 |
| 6,397,869 | B1 * | 6/2002 | Jennings | 135/93 |
| 6,449,147 | B2 | 9/2002 | Zheng | |
| 6,450,186 | B1 | 9/2002 | Pearcy | |
| 6,548,967 | B1 | 4/2003 | Dowling et al. | |
| 6,550,575 | B2 | 4/2003 | Spencer et al. | |
| 6,554,013 | B2 | 4/2003 | Brown | |
| 6,623,351 | B2 | 9/2003 | Brown | |
| 6,701,948 | B2 | 3/2004 | Jopp et al. | |
| 6,727,197 | B1 | 4/2004 | Wilson et al. | |
| 6,752,164 | B1 | 6/2004 | Park | |
| 6,766,623 | B1 | 7/2004 | Kalnay | |
| 6,773,140 | B2 | 8/2004 | Lee | |
| 6,876,173 | B2 | 4/2005 | Mastaler et al. | |
| 6,981,347 | B1 | 1/2006 | Walburger | |
| 7,031,147 | B2 | 4/2006 | Zheng | |
| 7,048,400 | B2 | 5/2006 | Murasko et al. | |
| 7,121,707 | B2 | 10/2006 | Currie et al. | |
| 7,152,614 | B2 | 12/2006 | Kalnay | |
| 7,357,526 | B2 | 4/2008 | Zeiler | |
| 7,427,101 | B1 | 9/2008 | Zernov | |
| 7,431,470 | B2 * | 10/2008 | Coleiro | 362/102 |
| 7,443,134 | B2 | 10/2008 | Phillips et al. | |
| 7,726,852 | B2 * | 6/2010 | Sanoner et al. | 362/398 |
| 7,836,906 | B2 | 11/2010 | Zheng | |
| 2002/0062852 | A1 | 5/2002 | Jopp et al. | |
| 2002/0083653 | A1 | 7/2002 | Hilbert | |
| 2002/0134415 | A1 | 9/2002 | Boulange | |
| 2003/0034205 | A1 | 2/2003 | Spencer et al. | |
| 2004/0052075 | A1 | 3/2004 | Lee | |
| 2004/0238021 | A1 * | 12/2004 | Holub et al. | 135/97 |
| 2006/0120090 | A1 | 6/2006 | Wikle et al. | |
| 2006/0241878 | A1 | 10/2006 | Jung et al. | |
| 2006/0272692 | A1 | 12/2006 | Wu | |
| 2007/0006907 | A1 | 1/2007 | Yueh | |
| 2007/0209694 | A1 * | 9/2007 | Gooch et al. | 135/91 |
| 2008/0000513 | A1 | 1/2008 | Jiu et al. | |
| 2008/0018303 | A1 | 1/2008 | Scheucher | |
| 2008/0029141 | A1 * | 2/2008 | Grand Pre et al. | 135/91 |
| 2008/0072945 | A1 * | 3/2008 | Grand Pre et al. | 135/91 |
| 2008/0265787 | A1 | 10/2008 | Golle | |

FOREIGN PATENT DOCUMENTS

| | | | |
|---|---|---|---|
| DE | 19800087 | | 7/1999 |
| FR | 2627846 | | 9/1989 |
| GB | 2390070 | A | 12/2003 |
| GB | 2442732 | A | 4/2008 |
| JP | 2-91445 | | 7/1990 |
| JP | 11-117578 | | 4/1999 |
| JP | 2002-185031 | A | 6/2002 |
| JP | 2002-258780 | A | 9/2002 |
| JP | 2007-115585 | A | 5/2007 |
| KR | 1986-0001831 | | 10/1984 |
| KR | 94-3628 | | 2/1994 |
| KR | 1998-0130255 | | 3/1997 |
| RU | 2219414 | | 12/2003 |
| WO | WO 88/05489 | | 7/1988 |
| WO | WO 93/00840 | | 1/1993 |
| WO | WO 95/12045 | | 5/1995 |
| WO | WO 01/53634 | A1 | 7/2001 |
| WO | WO 02/78035 | A1 | 10/2002 |
| WO | WO 2007/038751 | A | 1/2007 |

OTHER PUBLICATIONS

Coleman 2001 Exponent Product Catalog, The Coleman Company, Inc., Wichita, Kansas, pp. 15-16, 2000.

Kirkham's Outdoor Products, "Springbar® Expandable Model 7199K", printed at http://www.kirkhams.com/tabs/canvas/expandable/html, Apr. 3, 2003.

Northwest Territory®, "14' – 14' Vacation Cottage with Screened Porch".

Bass Pro Shops, "RedHead® Expedition Dome Tent Deluxe Vestibule," Bass Pro Shops: Fishing, Hunting and Outdoor Gear, 2 pgs (2004) printed at http://www.basspro.com/servlet/catalog.TextId?hvartechID=49295&hvarTarget=search&cmCat=SearchResults on May 20, 2004.

Bass Pro Shops, "RedHead® Expedition Dome Tent Deluxe Vestibule Adapter," Bass Pro Shops: Fishing, Hunting and Outdoor Gear, 2 pgs (2004) printed at http://www.basspro.com/servlet/catalog.TextId?hvarTextId=49297&hvarTarget=search&cmCat=SearchResults on May 20, 2004.

* cited by examiner

TENT ELECTRICAL SYSTEM

CROSS-REFERENCES TO RELATED APPLICATIONS

This application is a divisional of U.S. application Ser. No. 12/057,184, filed Mar. 27, 2008, which claims the benefit of PCT/US2006/038151, filed Sep. 28, 2006, which claims the benefit of U.S. provisional patent application Ser. No. 60/721,281, filed Sep. 28, 2005, and U.S. provisional patent application Ser. No. 60/774,371, filed Feb. 17, 2006, all of which are incorporated herein by reference.

TECHNICAL FIELD

The present invention generally relates to tents, and more specifically to a tent lighting system.

BACKGROUND

Camping is a popular pastime enjoyed by many. Most campers utilize recreational use tents, such as backpacking and family camping tents, while camping. In general, recreational use tents are structures made of light weight, often waterproof, fabrics. Typically, a recreational use tent is a collapsible shelter of polyester or other material stretched over and sustained by a frame, such as one or more poles. Recreational use tents come in a variety of shapes, including dome and cabin tents.

In addition to recreational use tents, some campers may use a free standing shelter that provides protection from sun, rain, or insects during leisure periods while the camper is not in the tent.

Often campers like to enjoy the luxuries of home while camping. For example, many campers bring lounge chairs or hammocks, portable air mattresses or cots, and other items to make the camping experience more comfortable and more like home. Often, modern conveniences require electrical power, which may not be available at a campsite.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, an electrical system is provided for a tent or shelter. A wiring harness is routed through a tent or shelter either by attaching the wiring harness to the tent or shelter, or integrating the wires into the fabric for the tent or shelter. As an example, the wiring harness may be sewn into a seam or hems of the tent or shelter.

In accordance with an embodiment, a socket is attached to the wiring harness and is mounted to the tent or shelter. The socket is attached to the tent or shelter, for example, at an upper portion or sidewall of the tent or shelter. The socket includes contacts that may engage a fixture or appliance, such as a light. An opposite end of a cord leading to the socket is attachable to a power supply, such as a battery box or battery pack. Examples of items that may be attached to and used with the socket include a light, a tent fan, a radio, a hairdryer, a combination fan and light, a misting system, a bug light, or a bug zapper.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
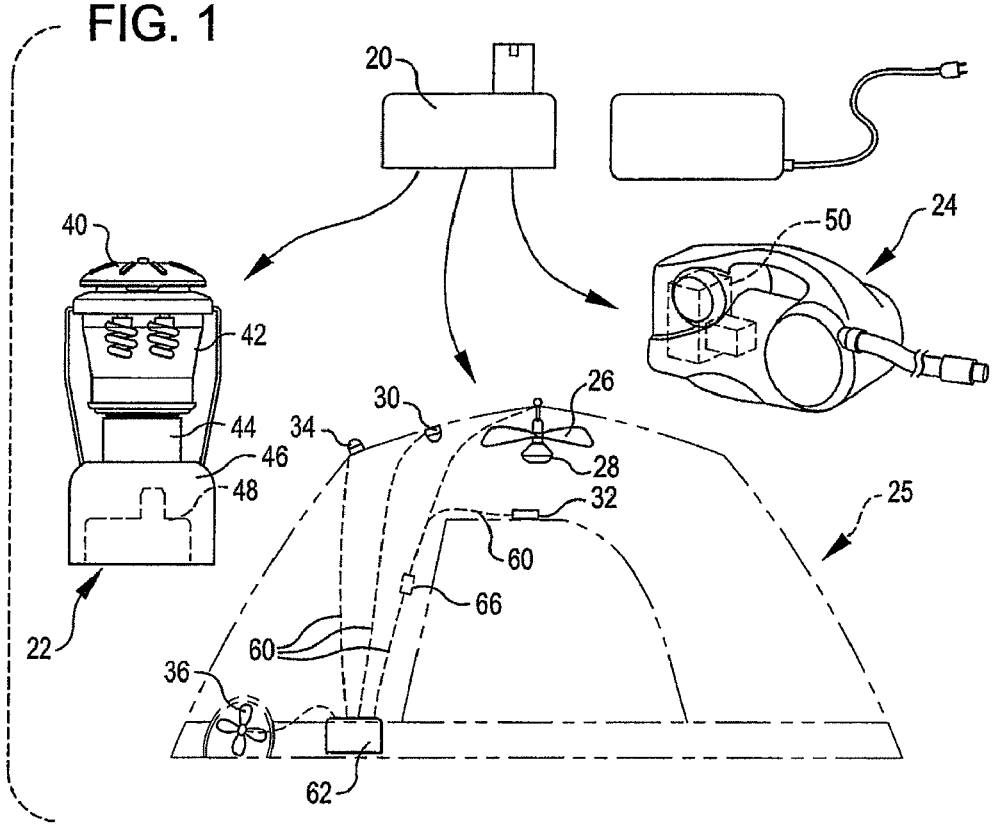
FIG. 1 is a diagrammatic representation of a battery pack in accordance with an embodiment of the invention, shown for use with a number of different devices.

Referring now to the drawings, in which like reference numerals represent like elements through the several views, FIG. 1 shows a battery pack 20 in accordance with an embodiment of the invention. As shown in the drawing, the battery pack 20 may be used in a lantern 22, an air pump 24 for an air bed or other inflatable device, or to supply power to a wiring system or wiring harness 60 for a tent 25, as examples.

The wiring harness 60 may be connected to a variety of different devices in a tent such as the tent 25, including, but not limited to, an overhead fan 26, an internal tent light 28, a nightlight 30, a porch light 32, a tent finder light 34, and/or a port fan 36. Each of these items is currently sold as a separate device that may be used in a tent, but are currently powered by rechargeable or disposable batteries that fit into the device. By using the wiring harness and the battery pack 20, the power source for the devices is removed from each device, allowing the devices to be made lighter and smaller.

The battery pack 20 may be a rechargeable battery, such as a nickel cadmium or a lithium rechargeable battery, or may be a container that holds one or more disposable batteries, such as dry cell batteries. An example of a container embodiment is described in more detail below.

In accordance with an embodiment, the lantern 22 includes conventional ornamental features of a fuel lantern. For example, the lantern 22 includes a ventilator cap 40, a globe 42, and a collar 44. In the embodiment shown in the drawings, the lantern 22 also includes a base 46 that is shaped like a typical fuel tank for a lantern. For the lantern 22, the base 46 includes a recess 48 for receiving the battery pack 20. The recess 48 is accessible from the bottom of the base 46, and the recess and the battery pack 20 are not visible when the lantern 22 is placed on a surface such as a table.

The air pump 24 is designed to inflate a variety of different inflatable products, including, for example, an air bed (not shown). The air pump 24 includes a recess 50 for receiving a battery pack 20.

Figure 2:
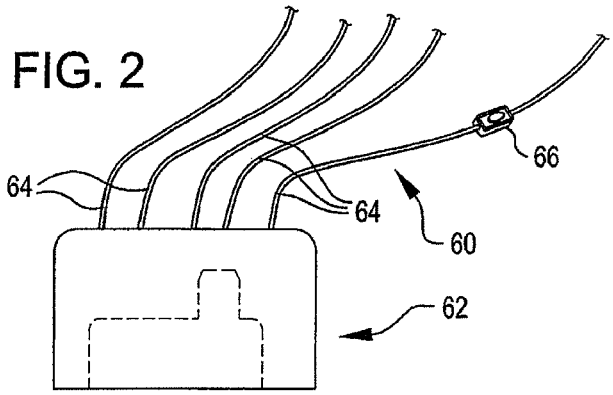
FIG. 2 is a side view representing a wiring harness in accordance with an embodiment of the invention.

Details of the wiring harness 60 in accordance with an embodiment are shown in FIG. 2. The wiring harness 60 includes a socket 62 for receiving the battery pack 20. A plurality of wires 64 extend outward from the socket 62 and are supplied power by the battery pack 20 when the battery pack is connected to the socket 62. If desired, one or more switches 66 (only one is shown in the drawings) may be provided along the wires 64 or on the socket 62 for turning on or off power through the associated wire 64.

Figure 3:
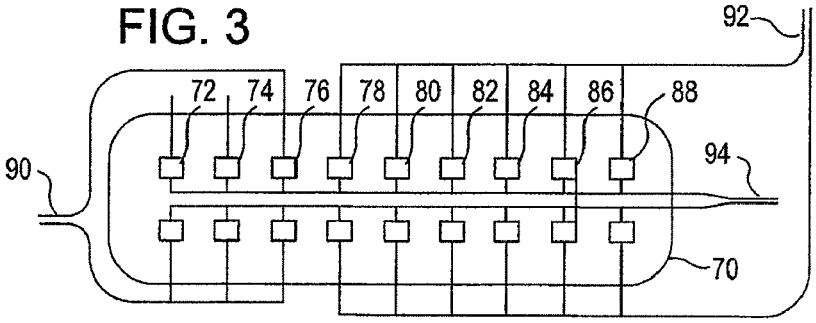
FIG. 3 is a top view representing contacts for a battery pack in accordance with an embodiment of the invention.

In accordance with an embodiment, the battery pack 20 may include more than one set of contacts. To this end, in accordance with one example shown in FIG. 3, the battery pack 20 includes a battery post 70 having nine sets of contacts 72, 74, 76, 78, 80, 82, 84, 86, 88. Each set of contacts 72-88 provides a portion of the total voltage supplied by the battery pack. In an embodiment, each of the sets of contacts provides the same amount of voltage, but different amounts may be supplied by different contacts. As one example, the nine sets of contacts 72-88 may each supply two volts, for a total of 18 volts supplied by the battery pack 20.

By supplying the battery pack 20 with a plurality of sets of contacts with a portion of the total voltage available at each of the contacts, a device may utilize a subset of the voltage available from the battery pack 20 by connecting to a subset of the contacts. As an example, a 6-volt line 90 may be connected only to the contacts 72, 74 and 76. This line 90 may be or connect to one of the wires 64 connected to the socket 62, or may be integrated into a device that connects directly to the battery pack 20, such as the air pump 24 or the lantern 22. As another example, a 12-volt line 92 is connected to the contacts 78-88. In a third example, an 18-volt line 94 is connected to all of the contacts 72-88. As can be understood, a variety of different combinations may be utilized to provide a desired voltage. By using a subset of the sets of contacts to provide a voltage less than the total voltage of the battery pack 20, a rheostat or similar device is not required for reducing current coming from the battery pack 20 and going to a device needing less than all of the voltage supplied by the battery pack.

Figure 4:
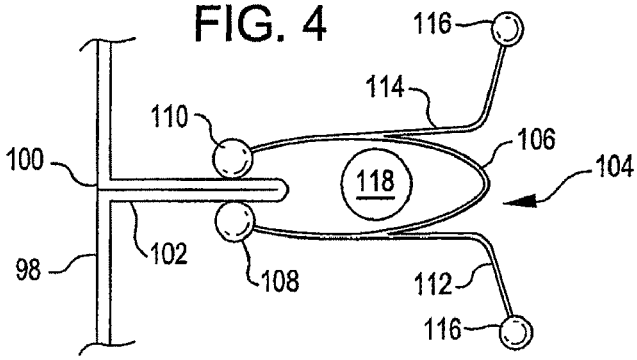
FIG. 4 is a top view showing a spring clip in accordance with an embodiment of the invention, with the spring clip attached to a hem of a tent.

In an embodiment, the wiring harness 60 may be provided with attachment structures that permit the wiring harness to be attached to an existing tent or shelter. An example of where the attachment structures may be attached is at a hem 102 that is formed at a seam 100 of a tent 98 (FIG. 4). The hem 102 is the excess material that exists due to stitching of two pieces of fabric together at a juncture of the two pieces of fabric. This excess material is often doubled back and stitched down, although not necessarily so. For a tent, the hem 102 is typically arranged on the inside of the tent. In the embodiment shown in FIG. 4, a spring clip 104 is arranged and configured to attach to such a hem 102.

In the embodiment shown in the drawings, the spring clip 104 includes a hoop 106 of spring steel. In the embodiment, rubber ends 108, 110 are attached to the ends of the hoop 106, but the ends 108, 110 may be made of another material. The bias of the hoop 106 forces the rubber ends 108, 110 together. Lever arms 112, 114 extend along the legs of the hoop 106 and include gripping surfaces 116 at their distal ends.

To install the spring clip 104, a user may grasp the two gripping surfaces 116 and press them together to force the rubber ends 108, 110 apart. The rubber ends 108, 110 may be clamped around a hem, such as the hem 102, to lock the spring clip 104 into position. A wire cable 118 may extend through the hoop 106 and may be supported by the spring clip 104. Several of the spring clips 104 may be provided for attaching the wiring harness 60 to the inside of an existing tent or shelter. The spring clips 104 may be distributed as necessary to support the wiring harness 60 and to route the wiring harness through the tent 98, a shelter, or other structure.

Figure 5:
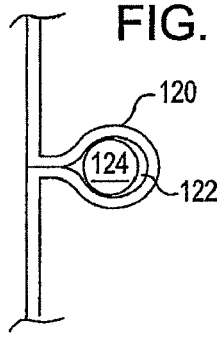
FIG. 5 is a top cross sectional view showing a wiring harness system in which wires for the system are integrated into a hem of a tent.

FIG. 5 shows an alternate way to attach the wiring harness 60 to a tent or a shelter. In the embodiment shown in FIG. 5, a hem 120 is formed with a pocket 122, for example by doubling the hem back onto itself and stitching down the end. A wire cable 124 is captured in the pocket 122. In this manner, the cable 124 is integrated in a tent, and may be sold with the tent. In an embodiment, ends of the cable extend beyond the seam so that devices, such as the overhead fan 26 or the night light 30, may be attached to the wiring harness 60. If desired, couplings or other connection devices may be included on the ends of the wires.

Wires may alternatively be incorporated directly into a seam or may otherwise be connected to or routed through fabric or other material in a tent or shelter. In an alternate embodiment, for example, a tent or shelter may include internal sleeves, loops, or other structures through which the wiring harness 60 may be routed. In addition, a pocket or other structure may be provided on a floor or wall of a tent for supporting the socket 62 and the battery pack 20.

As can be understood, the universal battery pack 20 of the present invention provides much flexibility in a camping environment. It may be used to provide power to a number of different items, including devices that are not attached to a tent or shelter, such as the lantern 22 or an air pump 24. In addition, camping tools, such as a camping chain saw, may be powered by such devices. A thermoelectric cooler may also be provided power with the battery pack 20. In addition, utilizing the wiring harness 60, a number of different items within or on a tent or that are associated with a shelter may be powered by the battery pack 20. A user may thus have a number of battery packs and use them as needed, and may recharge those battery packs with a single charger 130 (FIG. 1).

The battery pack 20 also provides a number of different options for sales of merchandise. For example, a single package, such as a "starter camping kit" may be sold having two battery packs 20, an air pump 24, a lantern 22, a tent, and an air bed. Alternatively, a tent, the wiring harness 60, two or more battery packs 20, and one or more of the tent devices, such as the overhead fan 26, the internal tent light 28, the night light 30, the porch light 32, the tent finder light 34, and the porch fan 36 may be sold as a set. Other options are available.

Figure 6:
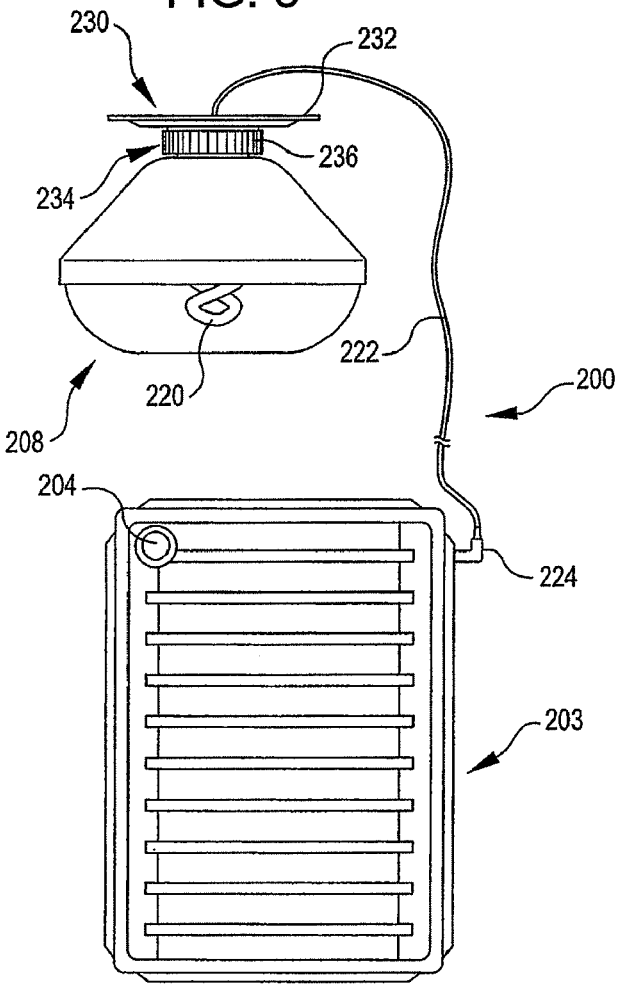
FIG. 6 shows a side view of a lighting system for a tent or shelter in accordance with an embodiment.

FIG. 6 shows an embodiment of a lighting system 200 that may be installed in a tent or shelter in accordance with the invention. As an example, the lighting system 200 is shown installed in a tent 201 in FIG. 8. By "tent," we mean a recreational use tent, such as a family camping tent, mountaineering tent, an expedition tent, or a backpacking tent, typically employing an integral floor 202.

The lighting system 200 is shown as used with a light 208, but may be used with any number of different appliances, as described below. To this end, the lighting system 200 is an electrical system for a tent or a shelter, and one type of appliance that may be used with the system is a light. For ease of description, however, the system is described herein as a "lighting system."

Figure 7:
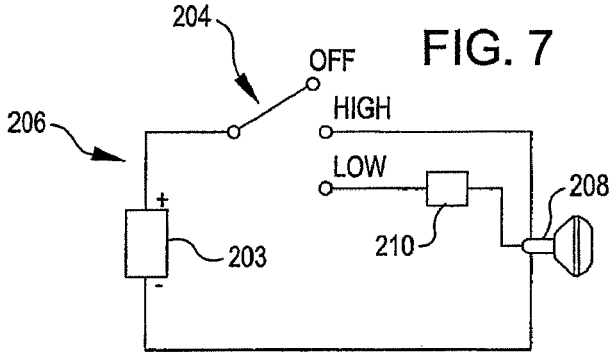
FIG. 7 shows a representation of a circuit for use in a battery box for the lighting system of FIG. 6.

Returning now to FIG. 6, the lighting system 200 includes a battery box 203 having a switch 204. A similar switch may alternatively be included in the appliances, such as the light 208, or in the wiring harness for the lighting system 200. In accordance with an embodiment, the switch 204 is connected to a circuit 206 (FIG. 7). Again, the circuit may be located at the battery box 203, an appliance (e.g., the light 208), or somewhere else in the lighting system 200. The switch 204 in the embodiment shown in FIG. 7 is a three-way switch, having an "OFF" position, a "HIGH" position, and a "LOW" position. At the "OFF" position, the circuit 206 is open. At the "HIGH" position, the power from the battery box 203 is supplied directly to an appliance (e.g., the light 208). At the "LOW" position, the current in the circuit is routed through a rheostat 210, which reduces the current so that a lower voltage is provided at the appliance. Alternatively, a portion of the voltage from the battery box 203 may be provided to the light 208, such as by using a subset of contacts provided by the battery box 203, as described above.

In accordance with an embodiment, the battery box 203 is designed to receive disposable dry cell batteries, such as eight (8) D cell batteries. However, other power sources may be used, including rechargeable batteries or a rectifier connected to an AC power cord.

Figure 8:
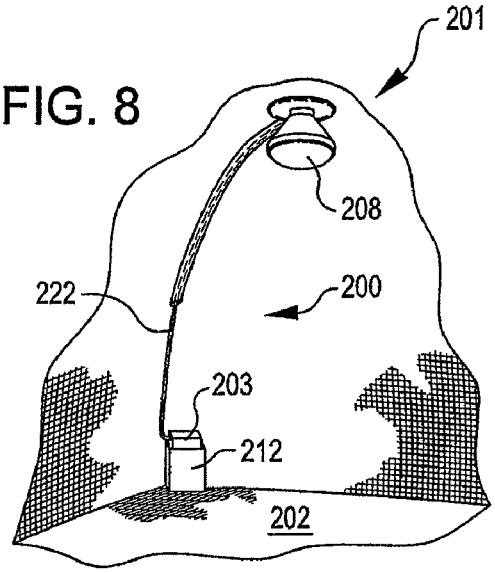
FIG. 8 shows the lighting system of FIG. 6 installed in a tent.

As can be seen in FIG. 8, a pouch 212 may be provided on the inside of the tent 201 for receiving the battery box 203. This pouch 212 may be positioned so that it is adjacent to the floor 202 of the tent, so that the battery box 203 rests on the floor on the tent and thus causes minimal drooping of the sides of the tent. In an alternate embodiment, the battery box and/or a tent or shelter may include other structures for attaching the battery box to structures within a tent or shelter, including, but not limited to, straps, fasteners, hooks, ties, clips, and clamps.

Figure 11:
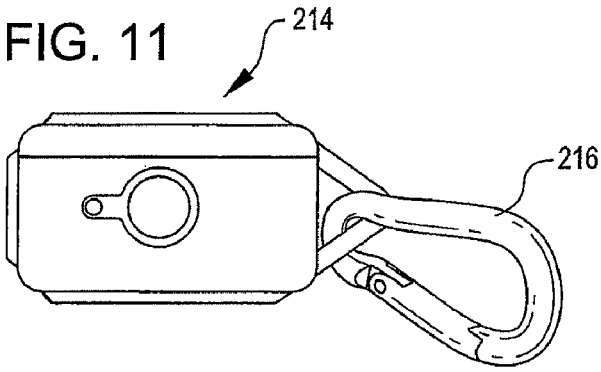
FIG. 11 shows a top view of a remote control that may be used with the battery box shown in FIG. 6 in accordance with an embodiment.

In an embodiment shown in FIG. 11, a remote control 214 is provided for controlling operation of the lighting system 200, for example by controlling operation of the switch 204. The remote control may utilize, as examples, infrared or radio frequency technology, to provide remote operation of the lighting system 200. In the embodiment shown in drawing, the remote control 214 includes a karabiner 216. This karabiner 216 may be clipped, for example, to a hook or loop on the inside of the tent so as to hang the remote control 214 in a suitable location. Other attachment structures may be used if desired.

The appliance may be, for example, a light 208 such as shown in FIG. 6, or any other appliance or device that may utilize power from the battery box 203 or other power source. Examples of devices include the list above described for use with the wiring harness 60, as well as a tent fan, a radio, an electronic air freshener, a hairdryer, speakers, a fan and light combination, a misting system, a bug light, a bug zapper, an electric lantern, an electric blanket, a hand mixer, a humidifier, or another suitable appliance.

The light 208 includes a bulb 220. In the embodiment shown in the drawings, the bulb 220 is fluorescent, but may alternatively be a light emitting diode (LED), an incandescent bulb, or another suitable lamp.

For the lighting system 200, a cord 222 extends between the light 208 and the battery box 203. In an embodiment, the cord 222 is connected to or routed through a tent such as is described above for the wiring harness 60. That is, the cord 222 may be permanently or temporarily attached to the fabric of the tent or shelter walls, or may otherwise be routed through the structure, so that the cord extends from a position where the battery box 203 is stored to the light 208.

In accordance with an embodiment, a shroud 230 is connected to the end of the cord 222 and is mounted at a top portion of the inside of a tent or shelter. In an alternate embodiment, the shroud 230 may be positioned at a side or other location in or on a tent or shelter. The shroud may be attached in many different ways to the tent, but in one embodiment is overmolded or sewn to the tent fabric. To this end, the shroud 230 includes a base 232 serving as a flange which may be trapped between layers of fabric of the tent and/or shelter. A threaded socket 234 extends inward from the base 232. The threaded socket 234 includes an outer knurled surface 236.

Figure 10:
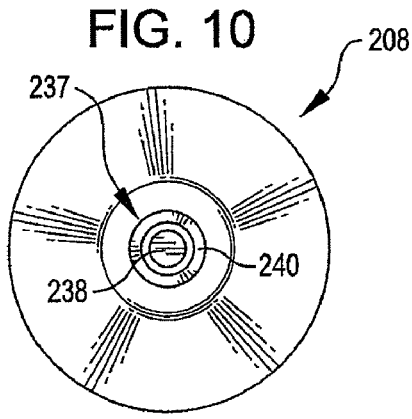
FIG. 10 shows a top view of the light of FIG. 9.
Figure 9:
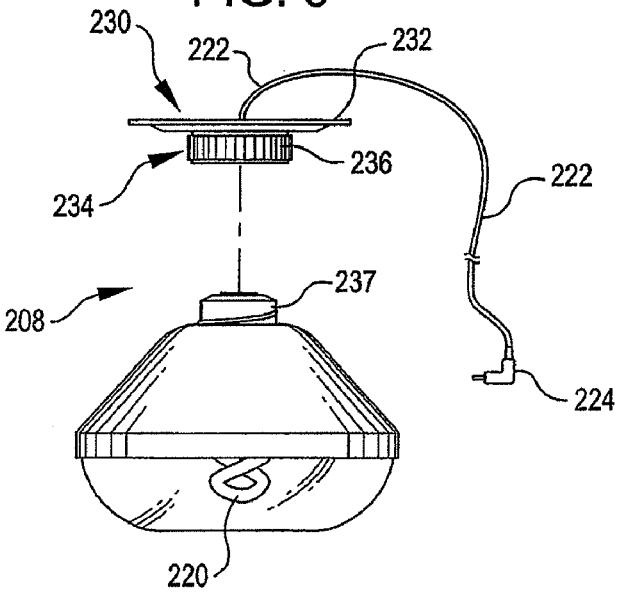
FIG. 9 shows a side view of a power socket and light for use in the lighting system of FIG. 6.

In accordance with an embodiment, the appliances described above, or other appliances, are designed to fit to the socket 234. To this end, the appliances include a threaded protrusion 237 (shown on the light 208 in FIG. 9) that threads into the socket 234. Contacts (not shown) are provided within the socket 234. These contacts are positioned such that when an appliance such as the light 208 is threaded into the socket 234, contacts 238, 240 (FIG. 10) on the light 208 or other appliance engage the contacts within the socket 234 and complete the circuit 206 at the appliance.

To aid in attachment of an appliance to the socket 234, the outer knurled surface 236 may be gripped by a user while the user is rotating the appliance into the socket 234. Threads on the appliance and the threaded socket 234 are matched so that a certain amount of rotation, such as 360 degrees, causes installation of the appliance and connection of the contacts 238, 240 with the contacts within the socket 234.

The various appliances described above may thread directly into the socket 234. Alternatively, the appliances may be provided with a cord, with the cord having at one end a protrusion similar to the threaded protrusion 237 on the light 208. The threaded protrusion on the cord may be rotated into the socket 234 so as to provide power, through the cord, to the appliance. Another type of connector or plug may be provided for attaching an appliance to the electrical system.

In an alternate embodiment, appliances may be configured to attach directly to the battery box 203. As such, the appliances may include a plug, such as the plug 224, for attaching to the battery box 203.

In an embodiment, the shroud 230 is mounted by a manufacturer, in a shelter or tent, such as the tent 201, along with the cord 222. The user need only attach the battery box 203 to the plug 224 to have available power to the socket 234. The user may then attach a desired appliance to the socket 234.

Figure 12:
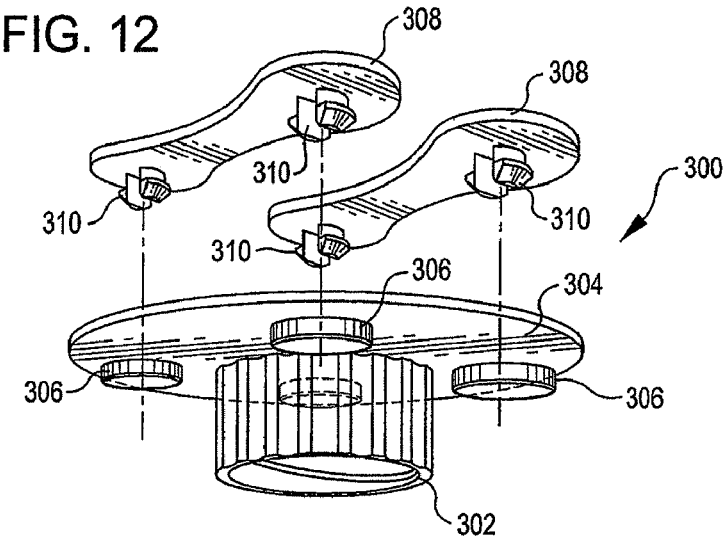
FIGS. 12 to 14 show three different connection systems for supporting a light socket in accordance with embodiments of the invention.

FIG. 12 shows an alternative embodiment of a connection system 300 for supporting a light socket 302, for example in a tent. The connection system includes a plate 304 having bosses 306 spaced around a periphery. The light socket 302 is mounted at the center of the plate 304. Connector plates 308 are provided having snaps 310.

In accordance with an embodiment, the connector plates 308 are aligned against an outside wall of a tent or shelter, and the plate 304 is aligned on the opposite side of a wall of a tent or shelter (i.e., on an inside wall). The snaps 310 either trap material and the snaps and the material are pressed into the corresponding boss 306, or openings are provided in the tent wall fabric to allow the snaps to enter the bosses. In either event, the connecting plates 308 and the plate 304 position and hold the light socket 302 against an inside wall of a tent.

Figure 13:
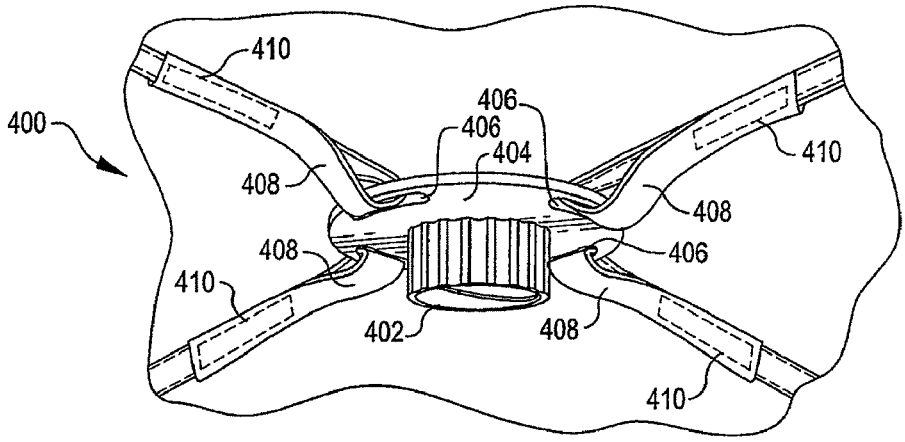
Figure 14:
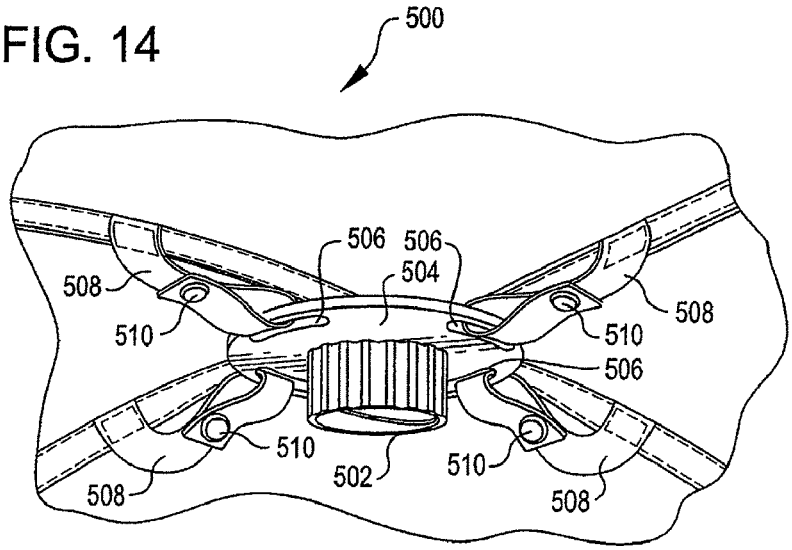

In another embodiment shown in FIG. 13, a connection system 400 includes a light socket 402 mounted on a plate 404. The plate 404 includes slots 406 spaced around its perimeter. Webbing 408 extends along seams of a tent or shelter, and is looped through the slots 406. Each webbing 408 is looped back onto itself and is sewn or otherwise attached at an attachment location 410. If desired, attachment of the webbing 408 at the attachment location 410 may utilize releasable attachments, such as hook and loop closures, snaps, or other features. As an example, FIG. 14 shows a connection system 500 having a light socket 502 mounted on a plate 504 having similar slots 506. In the embodiment shown in FIG. 14, the webbing 508 attaches by snaps 510 to itself. In this manner, the connection system 500 is removably attachable to a tent or shelter.

A socket may be attached in a number of other ways, including sewing a base plate to a tent or shelter, or placing magnetic/metal strips or plates on each side of the fabric to hold the assembly together via the magnetic force. As another option, the socket may be detachable from a base. For example, a base or holder may be sewn to the fabric of a tent or shelter, and the light socket may be attached to this base or holder by clips, clasps, fasteners, or a sliding lock mechanism, as examples.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tent or shelter, comprising:

fabric forming a structure for the tent or shelter and defining an interior space of the tent or shelter; and an electrical system comprising:

a plate having at least one opening therethrough;

webbing connected directly to the fabric and supported by the fabric, the webbing extending through said at least one opening;

a socket connected to the plate and configured and arranged for removably receiving an appliance such that the appliance extends at least partially into the interior space;

a wiring harness connected to the socket and attached to or routed through the tent or shelter; and an electrical power supply attached to the wiring harness for providing power to the socket.

2. The tent or shelter of claim 1, wherein a connection of the wiring harness to the tent or shelter comprises wires for the wiring harness mounted in a hem of the tent or shelter.

3. The tent or shelter of claim 1, wherein a connection of the wiring harness the tent or shelter comprises wires for the wiring harness clipped to a hem of the tent or shelter.

* * * * *